US009926659B2

(12) United States Patent
Kim et al.

(10) Patent No.: US 9,926,659 B2
(45) Date of Patent: Mar. 27, 2018

(54) WASHING MACHINE HAVING A PLURALITY OF TUBS

(71) Applicant: LG ELECTRONICS INC., Seoul (KR)

(72) Inventors: Sungmin Kim, Seoul (KR); Daeyun Park, Seoul (KR); Jongseok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 431 days.

(21) Appl. No.: 14/607,656

(22) Filed: Jan. 28, 2015

(65) Prior Publication Data

US 2015/0211167 A1 Jul. 30, 2015

(30) Foreign Application Priority Data

Jan. 29, 2014 (KR) ..... 10-2014-0011774

(51) Int. Cl.

| | |
|---|---|
| ***D06F 29/00*** | (2006.01) |
| ***D06F 31/00*** | (2006.01) |
| ***D06F 37/08*** | (2006.01) |
| ***D06F 37/10*** | (2006.01) |
| ***D06F 37/30*** | (2006.01) |
| ***D06F 39/08*** | (2006.01) |
| ***D06F 39/14*** | (2006.01) |

(52) U.S. Cl.

CPC ..... *D06F 31/00* (2013.01); *D06F 29/00* (2013.01); *D06F 37/08* (2013.01); *D06F 37/10* (2013.01); *D06F 37/30* (2013.01); *D06F 39/08* (2013.01); *D06F 39/14* (2013.01)

(58) Field of Classification Search

CPC ..... D06F 29/00; D06F 31/00; D06F 37/08; D06F 37/10; D06F 37/30; D06F 39/08; D06F 39/14

USPC ..... 68/9, 11, 19, 19.1, 19.2, 27, 140, 232, 68/237

See application file for complete search history.

(56) References Cited

U.S. PATENT DOCUMENTS

| | | | |
|---|---|---|---|
| 3,696,521 | A | 10/1972 | Hubbard |
| 6,671,978 | B1 | 1/2004 | McGowan et al. |

FOREIGN PATENT DOCUMENTS

| | | | |
|---|---|---|---|
| CN | 1888274 | A | 1/2007 |
| CN | 103061083 | A | 4/2013 |
| CN | 203113119 | U | 8/2013 |
| EP | 1634987 | A1 | 3/2006 |
| EP | 2415920 | A1 | 2/2012 |
| EP | 2602378 | A1 | 6/2013 |

*Primary Examiner* — Levon J Shahinian

(74) *Attorney, Agent, or Firm* — Dentons US LLP

(57) ABSTRACT

A washing machine having a plurality of tubs includes a cabinet having a first tub disposed therein, a first door, having a second tub disposed therein, to open and close a laundry introduction opening formed at the cabinet, a second door to open and close a laundry introduction opening of the second tub, a first water supply part and a second water supply part to supply washing water to inside of the first tub and the second tub, respectively, and a first water discharge part and a second water discharge part to discharge washing water from the first tub and the second tub, respectively. This configuration allows a washing process to be performed at a plurality of spaces.

13 Claims, 17 Drawing Sheets

WASHING MACHINE HAVING A PLURALITY OF TUBS

CROSS-REFERENCE TO RELATED APPLICATION

Pursuant to 35 U.S.C. § 119(a), this application claims the priority benefit of Korean Application No. 10-2014-0011774, filed on Jan. 29, 2014, the contents of which is incorporated herein by reference in its entirety.

BACKGROUND

1. Field

The present disclosure relates to a washing machine, and more particularly, to a washing machine having a plurality of tubs.

2. Background

Generally, a clothes treating apparatus may include a washing machine having a washing function, a washing machine having a washing function and a drying function, and a dryer. The clothes treating apparatus includes a drum into which laundry is introduced. In the case of a washing machine, a tub for accommodating washing water is further provided, and a drum is rotatably installed in the tub.

FIG. 1 is a sectional view of a washing machine, one example of a clothes treating apparatus in accordance with the conventional art. As shown, the washing machine includes a cabinet 11, a tub 21 accommodated in cabinet 11, and a drum 31 rotatably installed in the tub 21.

An opening 12 into which laundry is introduced, and a door 13 are provided on a front surface of cabinet 11. Tub 21 is supported in cabinet 11 by a spring 22 and a damper 23. Tub 21 has a cylindrical shape of which one side is open, and drum 31 is rotatably installed in tub 21.

Drum 31 has a cylindrical shape of which front side is open, and a plurality of through holes 33 are formed on a circumferential surface of drum 31. A plurality of lifts 35 for lifting laundry are provided on an inner surface of drum 31.

A driving motor 25 for rotating drum 31 is coupled to a rear side of tub 21, and a water discharge passage 27 having a water discharge pump 28 for discharging water is provided at a bottom portion of drum 31.

A detergent introduction device 41 for supplying detergent is provided at an upper side of tub 21, and a water supply pipe 43 is connected to the detergent introduction device 41. A water supply valve 45 is provided at water supply pipe 43.

Referring to FIG. 1, the conventional washing machine is provided with only one tub 21. Thus, when laundry required to be washed separately is mixed with each other, the laundry should be washed a plurality of times. Further, in a case where opening 12 is formed on a front surface of cabinet 11, once a washing process starts, door 13 cannot be open. In this case, laundry which has not been introduced into drum 31 cannot be re-introduced into drum 31.

Further, in the conventional washing machine, tub 21 has a capacity large enough to wash voluminous laundry such as bedding (blanket) or coat. Thus, when a small amount of laundry such as socks or underwear is washed, more washing water and/or power than a predetermined amount is consumed.

SUMMARY

Therefore, one object is to provide a washing machine having a plurality of tubs capable of simultaneously washing a plurality of laundry which should be separately washed.

Another object is to provide a washing machine having a plurality of tubs capable of preventing the consumption of more than a required amount of washing water or energy, when washing a small amount of laundry.

To achieve these and other advantages and in accordance with the purpose of this specification, as embodied and broadly described herein, there is provided a washing machine including: a cabinet having a first tub disposed therein; a first door, having a second tub disposed therein, to open and close a laundry introduction opening formed at the cabinet; a second door to open and close a laundry introduction opening of the second tub; a first water supply part and a second water supply part to supply washing water to inside of the first tub and the second tub, respectively; and a first water discharge part and a second water discharge part to discharge washing water from the first tub and the second tub, respectively.

With this configuration, the same effect as the provision of a plurality tubs can be obtained without changing the entire size of the washing machine. Further, a washing process can be performed in a plurality of spaces with a plurality of tubs. Further, a washing process can be performed by using a proper tub according to the amount of laundry.

In an embodiment, the first door may include a bowl member forming the second tub, a door frame to support an outer circumferential surface of the bowl member, and a hinge assembly to rotatably mount the door frame to the cabinet. The second water supply part and the second water discharge part may include a water supply passage and a water discharge passage disposed in the door frame, respectively.

In an embodiment, the water supply passage may include one or more injection nozzles to inject washing water into the second tub, and the injection nozzles may be radially disposed along the door frame to thus radially supply washing water into the second tub.

In an embodiment, the water supply passage and the water discharge passage may extend to inside of the cabinet, through the hinge assembly.

In an embodiment, couplers connected to the water supply passage and the water discharge passage may be provided in the hinge assembly. The couplers may be provided on the right and left sides of the laundry introduction opening, respectively.

According to another aspect of the present invention, there is provided a washing machine including: a cabinet having a first tub and a first drum disposed therein; a first door, having a second tub disposed therein, to open and close a laundry introduction opening formed at the cabinet; a second drum rotatably disposed in the second tub; a driving unit to rotate the second drum within the second tub; a second door to open and close a laundry introduction opening of the second tub; a first water supply part and a second water supply part to supply washing water to the first tub and the second tub, respectively; and a first water discharge part and a second water discharge part to discharge washing water from the first tub and the second tub, respectively.

In this configuration, the same effect as provision of a plurality tubs and drums can be obtained without changing the entire size of the washing machine. Further, a washing process, a rinsing process, and a dehydration process can be performed in a plurality of spaces. Further, a washing process can be performed by using a proper tub according to the amount of laundry.

The first door may include a bowl member forming the second tub, a door frame to support an outer circumferential surface of the bowl member, and a hinge assembly to rotatably mount the door frame to the cabinet.

The driving unit may include pinion gears mounted inside the door frame, and a driving motor to rotate the pinion gears. The pinion gears may be arranged to be engaged with rack gears formed on an outer circumferential surface of the second drum, thereby transmitting a rotational force to the second drum. The driving motor and the pinion gears may be arranged at an upper part of the door frame.

The driving unit for rotating the second drum may include a plurality of magnets radially arranged on an outer circumferential surface of the second drum, and a stator core and coils disposed at the bowl member and facing the magnets.

The second door may be positioned on a front surface of the cabinet.

A rotational shaft for supporting a rear surface of the second drum may be provided at the second tub.

The first door may include: a door frame to open and close the laundry introduction opening; a second tub forming member protruding from the door frame toward a rear side of the cabinet to form a space between itself and the door frame, and including a laundry introduction opening open toward a rear side of the cabinet; and a hinge assembly configured to mount the door frame so as to be rotatable with respect to the cabinet.

The driving unit may include: a rotational shaft connected to the second drum by passing through the second tub forming member; and a driving motor disposed at the space between the second tub forming member and the door frame to rotate the rotational shaft.

The second water supply part and the second water discharge part may include a water supply passage and a water discharge passage disposed on an outer circumferential surface of the door frame, respectively.

The water supply passage may include one or more injection nozzles to inject washing water into the second tub.

The water supply passage and the water discharge passage may extend to inside of the cabinet, through the hinge assembly.

The full scope of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION

Preferred embodiments of the present invention shown in the attached drawings are related to a washing machine. However, the present invention is not limited to this, but is applicable to a washing machine having a drying function as well as a washing function, etc.

Figure 1:
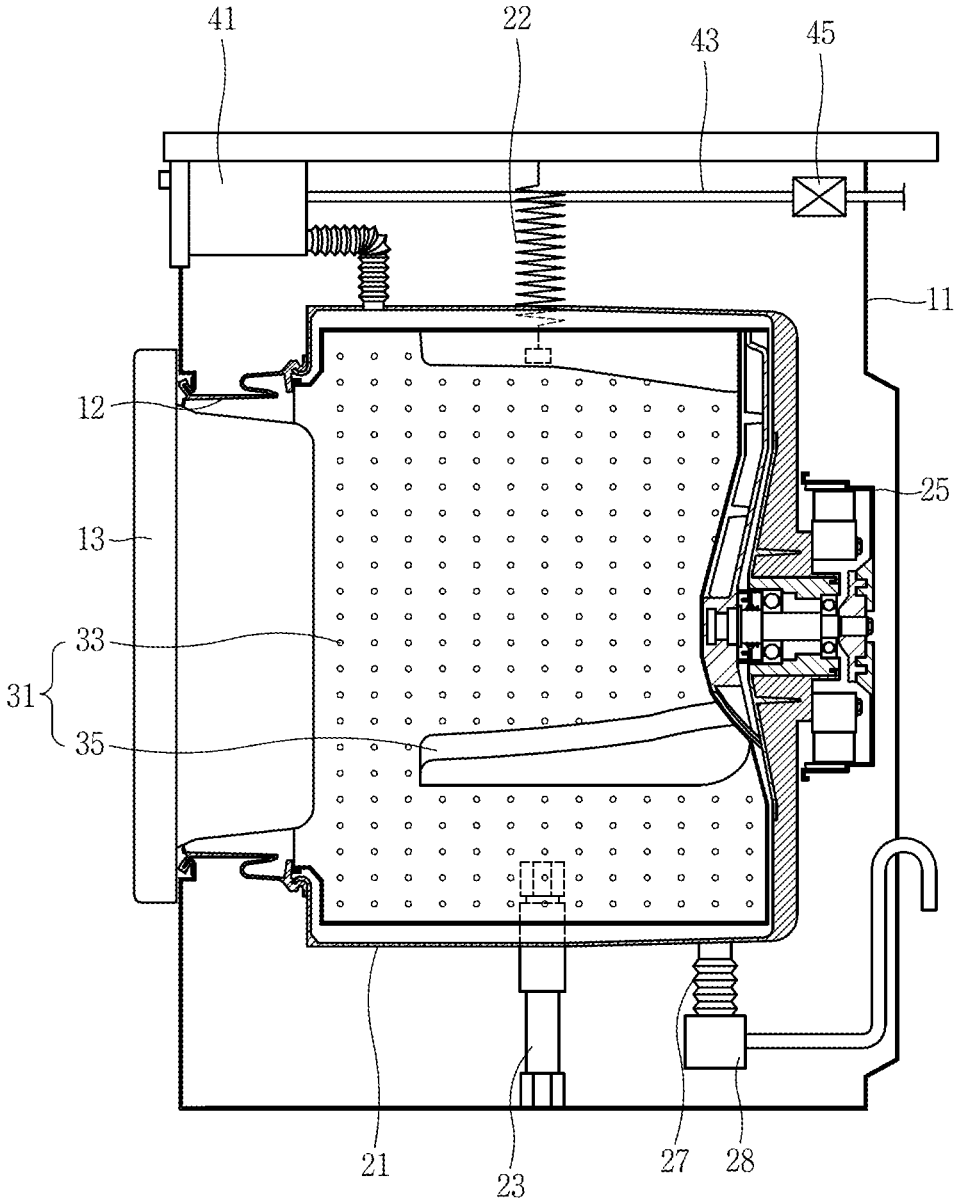
FIG. 1 is a side sectional view illustrating a washing machine in accordance with the conventional art.
Figure 2:
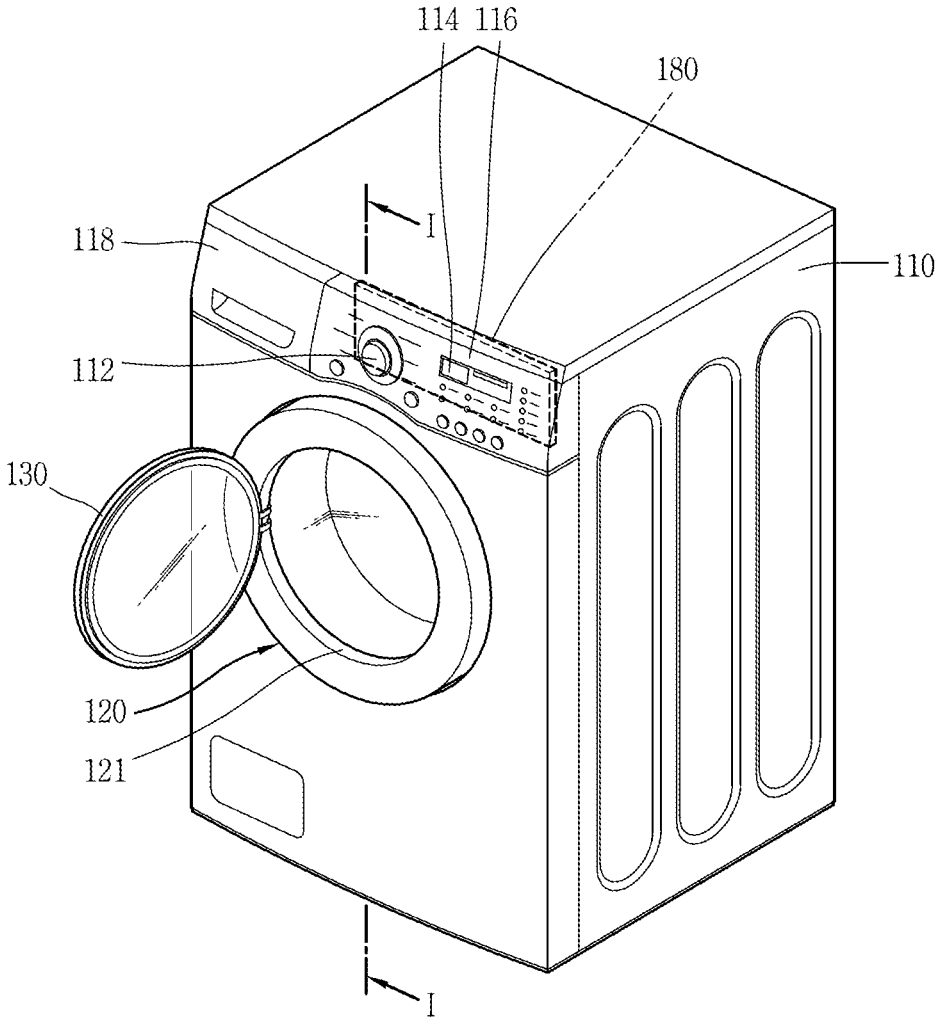
FIG. 2 is a perspective view of a washing machine having a plurality of tubs according to a first embodiment of the present invention, which illustrates that a second door is open and a first door is closed.
Figure 3:
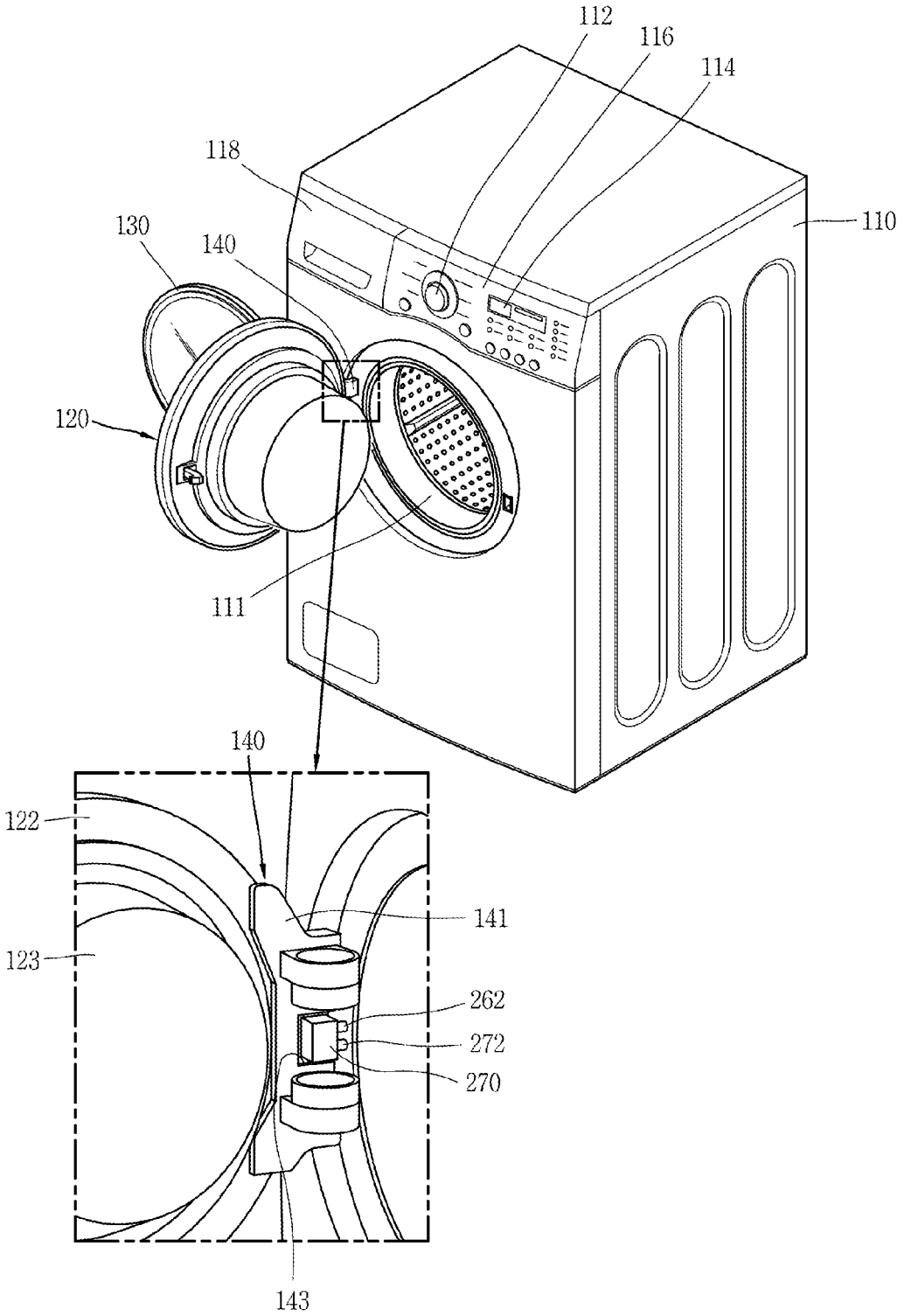
FIG. 3 is a perspective view illustrating that both the first door and the second door of the washing machine of FIG. 2 are open.
Figure 4:
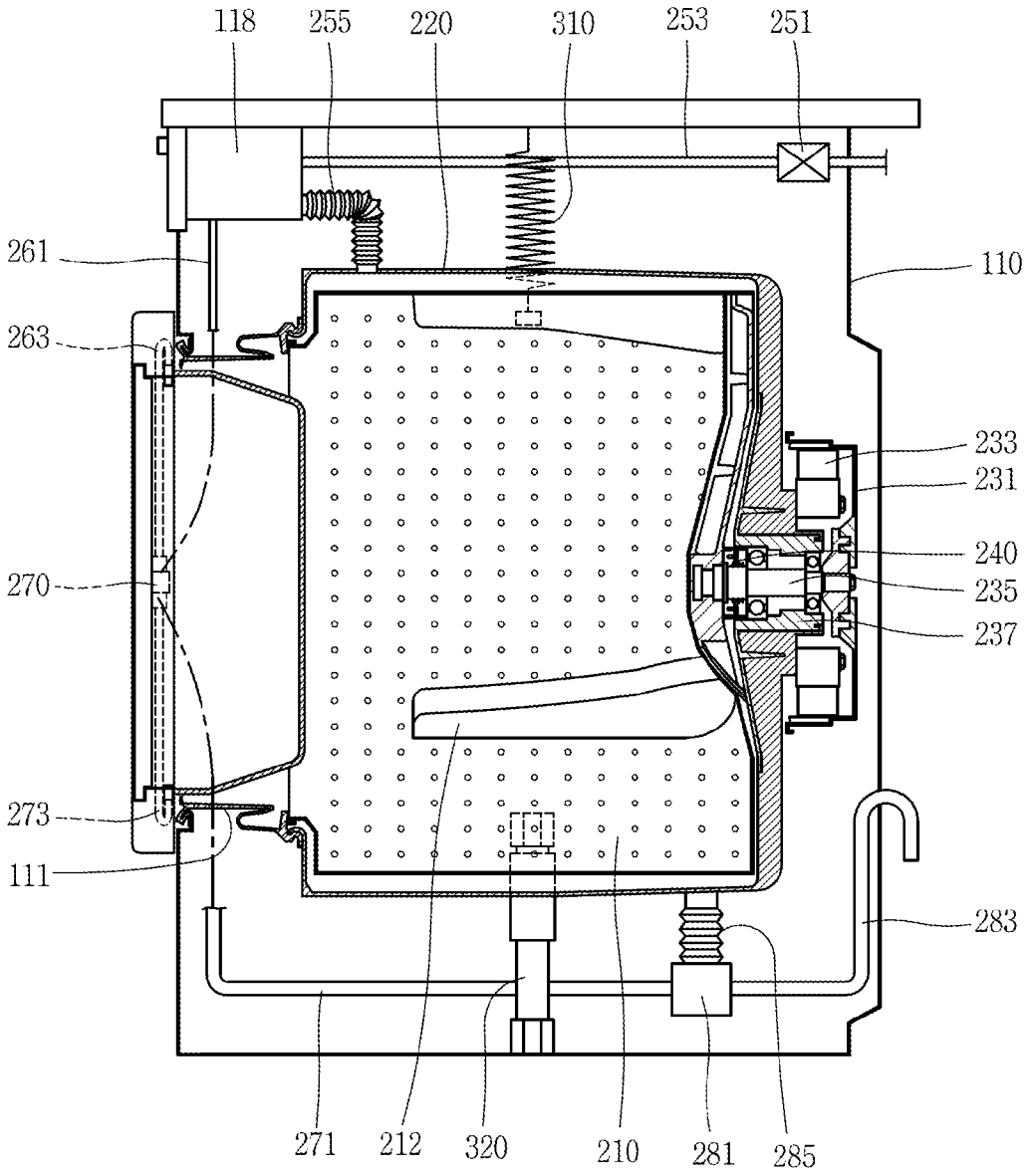
FIG. 4 is a sectional view taken along line 'I-I' in FIG. 2.

FIGS. 2 and 3 are perspective views of a washing machine having a plurality of tubs according to a first embodiment of the present invention, and FIG. 4 is a sectional view taken along line 'I-I' in FIG. 2.

Referring to FIGS. 2 and 3, the washing machine having a plurality of tubs according to a first embodiment of the present invention includes a cabinet 110 which forms an appearance of the washing machine. A control panel 116, which includes a manipulation portion 112 and a display device 114, is provided at an upper side of a front surface of the cabinet 110. Manipulation portion 112 is configured to manipulate the washing machine, and display device 114 is configured to inform an operation status of the washing machine to a user. A detergent supply device 118, configured to store therein detergent to be used during a washing process, is provided at an upper side of the front surface of cabinet 110.

A first door 120 is installed below control panel 116. Referring to FIG. 3, first door 120 is provided with a hinge assembly 140 on the left side, and is installed to rotate centering around a hinge joint. First door 120 is configured to open and close a laundry introduction opening 111 formed on the front surface of cabinet 110. Laundry introduction opening 111 is communicated with an inner space of a first drum 210, and laundry is introduced into or withdrawn from the first drum 210 through laundry introduction opening 111. A detailed configuration of first door 120 will be explained later.

Cabinet 110 has an approximate rectangular shape, and is provided with components therein for washing laundry. Referring to FIG. 4, a first tub 220 having a cylindrical shape and configured to store therein washing water is provided at an accommodation space formed in cabinet 110. First drum 210 is rotatably installed in first tub 220.

First tub 220 has an approximate cylindrical shape, and is connected to the laundry introduction opening 111 as a front surface thereof is open. A gasket, configured to seal a front side of first tub 220 and laundry introduction opening 111, is provided between a front surface of the first tub 220 and the laundry introduction opening 111. First tub 220 is supported by a spring 310 and a damper 320 installed in cabinet 110.

First drum 210 is provided with a plurality of through holes, and washing water flows to first tub 220 via the drum 210. Alternatively, washing water may be introduced into first drum 210 from first tub 220. A plurality of lifts 212, configured to lift up laundry, are provided on an inner surface of first drum 210.

A first driving portion configured to drive first drum 210 is installed at a rear side of the tub 220. The first driving portion includes a first stator 233 and a first rotor 231, and transmits a rotational force to first drum 210 by being connected to first drum 210 by a rotational shaft 235. Rotational shaft 235 is supported by a bearing 237. A sealing member 240, configured to seal for prevention of leakage of washing water from first drum 210, is provided at a connection part between the rotational shaft 235 and the first drum 210.

A first water supply part for supplying washing water into first tub 220, and a first water discharge part for discharging washing water from first tub 220 are provided in the cabinet 110. The first water supply part includes a first tub water supply passage 255 installed between the detergent supply device 118 and the first tub 220. First tub water supply passage 255 is formed as a bellows-type tube, and is configured to supply water mixed with detergent while passing through detergent supply device 118, to first tub 220. Then, the washing water introduced into first tub 220 is discharged from first tub 220 through the first water discharge part. The first water discharge part includes a first tub water discharge passage 285 extending from a lower surface of first tub 220, to a water discharge pump 281. First tub water discharge passage 285 is formed as a bellows-type pipe installed on a lower surface of first tub 220. Washing water, which has moved from the first tub water discharge passage 285 to the water discharge pump 281, is discharged to outside of cabinet 110 through a pipe 283 extending from the water discharge pump 281 to the outside.

Detergent supply device 118 is configured to accommodate therein detergent such as washing detergent, fabric softener, or a bleaching agent, and is configured to mix raw water introduced thereinto with the detergent accommodated therein. Detergent supply device 118 may be formed so as to be drawn to a front side of cabinet 110. Further, detergent supply device 118 is connected to a raw water supply pipe 253 to thus be supplied with raw water. Raw water supply pipe 253 is configured to transmit raw water supplied from an external water source, to the detergent supply device 118. A water supply valve 251 is installed at the raw water supply pipe 253, thereby controlling supply of raw water.

A second tub is formed at the first door 120, and washing water may be supplied to the second tub for a washing process. Referring to FIGS. 2 to 6, a bowl member 123 which forms the second tub is installed at a door frame 122 of the first door 120. Door frame 122, a ring-shaped frame which forms an outer circumference of first door 120, has its middle part open in a circular shape. As the middle part of door frame 122 is open in a circular shape, a laundry introduction opening 121 of the second tub is formed.

Referring to FIG. 2, a second door 130 is connected to a left side of the door frame so as to rotate centering around a hinge shaft, thereby opening and closing the laundry introduction opening 121 of the second tub.

Figure 5:
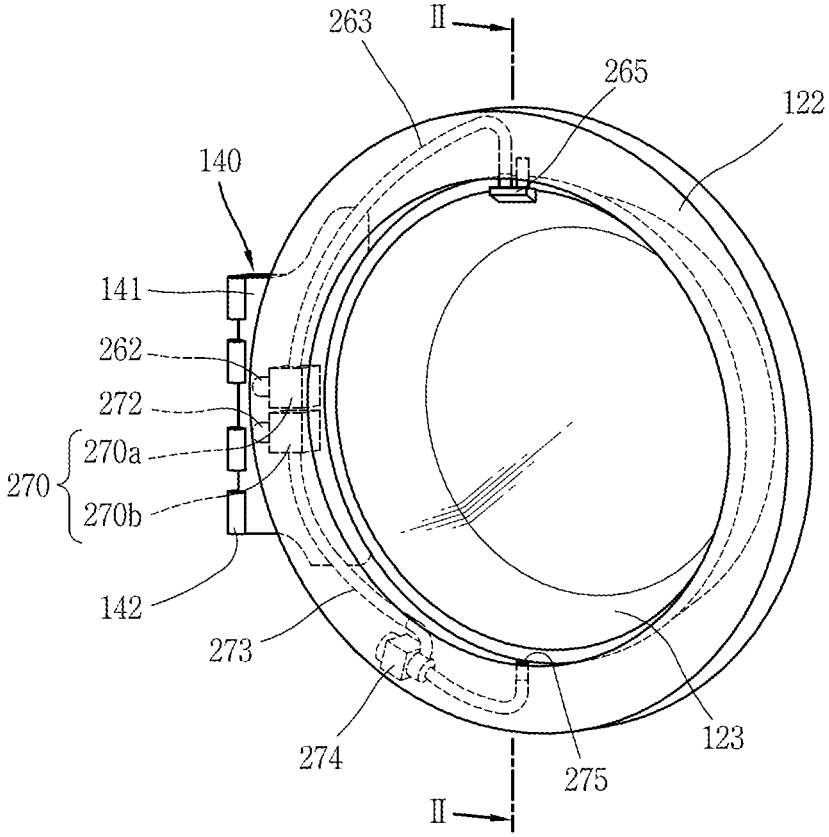
FIG. 5 is an enlarged perspective view illustrating a water supply passage and a water discharge passage installed at the first door of FIG. 2.

Bowl member 123, which has a hollow cylindrical shape, forms the second tub, a space for accommodating laundry. Bowl member 123 is communicated with laundry introduction opening 121 formed at door frame 122, as a front surface thereof is open. Referring to FIGS. 3 to 5, bowl member 123 is arranged such that a side surface on an outer circumference thereof is enclosed by laundry introduction opening 111 of the first tub 220. Further, bowl member 123 is arranged such that a rear surface thereof almost blocks an opening of first tub 220, in order to prevent laundry accommodated in first drum 210 from being disposed between bowl member 123 and laundry introduction opening 111.

Figure 6:
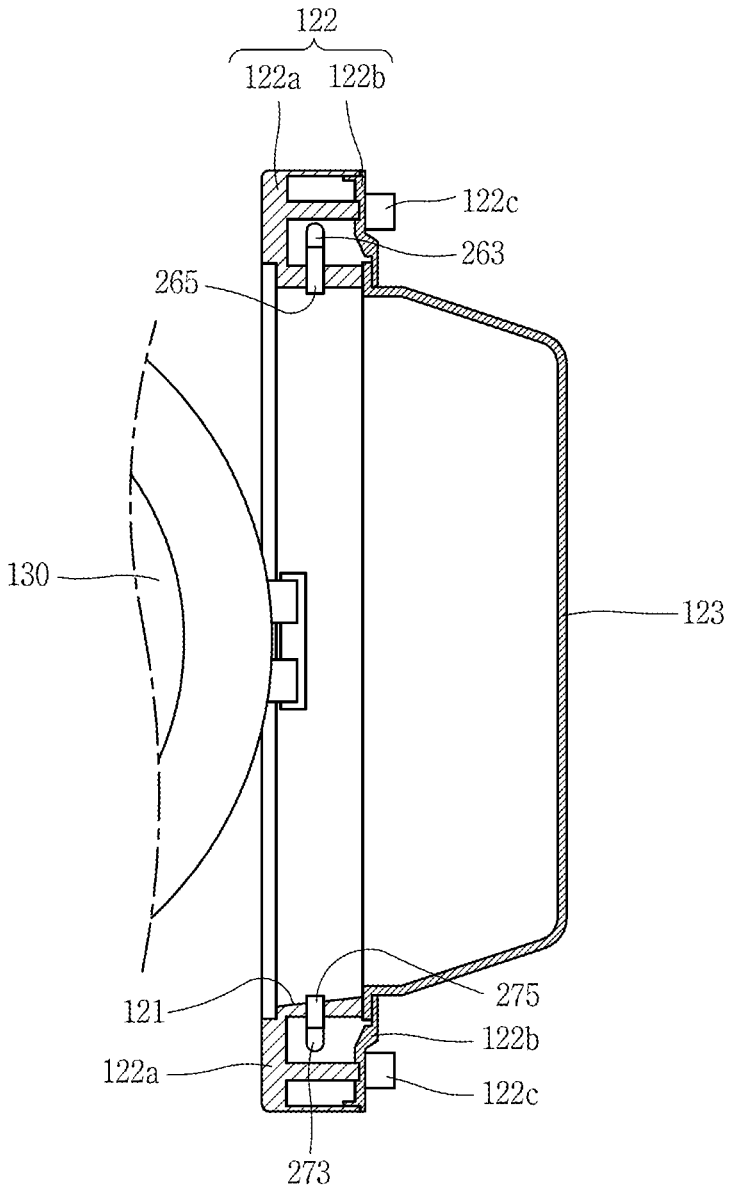
FIG. 6 is a sectional view taken along line 'II-II' in FIG. 5.

Bowl member 123 is supported as an outer circumferential edge thereof is fixed to the door frame 122. Referring to FIGS. 5 and 6, door frame 122 includes an outer frame **122*a* which forms a front surface of the door frame 122, and an inner frame 122*b* which forms a rear surface of door frame 122. Bowl member 123 is fixed by being fitted between outer frame 122*a* and inner frame 122*b*, as its outer circumferential edge is formed to have a flange shape. Once bowl member 123 is fixed to door frame 122, the laundry introduction opening 111 is closed by door frame 122 and a rear surface of bowl member 123 when first door 120 is closed. In this case, sealing member 122*c* having an elastic ring shape is attached to inner frame 122*b*, thereby sealing a gap between door frame 122 and the laundry introduction opening 111**.

In this configuration, since the second tub is formed at the first door 120, a predetermined space of first door 120, which has served only as a door, is utilized as the second tub. One advantage of this configuration is that a plurality of tubs are provided without changing an entire size of the washing machine. Thus, a washing process and a rinsing process can be performed at a plurality of spaces.

Further, since the second tub has a smaller size than the first tub as it is installed in the first door, a small amount of laundry can be easily washed, and a washing process can be efficiently performed even with a small amount of washing water. Thus, in case of washing a small amount of laundry, the second tub having a smaller size than the first tub is used, thereby reducing the amount of washing water consumed and thus reducing costs (charges or bills).

Further, since second door 130 is installed on a front surface of first door 120, laundry can be put into the second tub even while a washing process using the first tub is performed.

Referring to FIG. 3, a hinge assembly 140 of first door 120 is installed such that first door 120 rotates centering around a hinge shaft when opening and closing the laundry introduction opening 111. Hinge assembly 140 includes a hinge supporting portion 141 coupled to a rear surface of door frame 122, i.e., the inner frame **122*b*, and coupled to a front surface of cabinet 110 by a hinge shaft. For this, hinge supporting portion 141 is provided with hinge shaft accommodation portions 142 for accommodating the hinge shaft, at side edges in parallel to each other. Further, a space 143, configured to accommodate a connector 270 and couplers 262, 272 between a front surface of cabinet 110 and door frame 122, is further formed at hinge supporting portion 141**.

The second water supply part is configured to supply washing water to the second tub formed by bowl member 123. The second water supply part is disposed in door frame 122, and extends to inside of cabinet 110 through hinge assembly 140.

The second water supply part includes a second tub injection nozzle 265 installed at an upper part of an inner circumferential surface of door frame 122, and configured to inject washing water into the second tub; a second tub water supply passage 263 extending up to hinge assembly 140 along door frame 122, and configured to supply washing water to the second tub injection nozzle 265; and a water supply connection pipe 261 connected to the second tub water supply passage 263 at hinge assembly 140, and extending to detergent supply device 118. Water supply connection pipe 261 is provided in cabinet 110.

However, water supply connection pipe 261 is not limited to this. That is, as another embodiment, the water supply connection pipe may extend to water supply valve 251, without extending to the detergent supply device, thereby directly supplying raw water to the second tub water supply passage 263. In still another embodiment, the water supply connection pipe may be configured to selectively supply detergent liquid generated from the detergent supply device, or raw water supplied from an external water source, to the second tub water supply passage 263.

Connector 270 is provided at the space 143 formed between a front surface of cabinet 110 and door frame 122 by hinge assembly 140, thereby connecting the second water supply part and a second water discharge part to inside of cabinet 110 through hinge assembly 140. Connector 270 includes a water supply side connector 270*a* for fixing the second water supply part, and a water discharge side connector 270*b* for fixing the second water discharge part. Water supply side connector 270*a* and water discharge side connector 270*b* may be integrally formed with each other, thereby fixing the second water supply part and the second water discharge part. Alternatively, water supply side connector 270*a* and water discharge side connector 270*b* may be formed as separate members.

Couplers 262, 272 are connected to the second water supply part and the second water discharge part, respectively, thereby connecting a passage extending along door frame 122 to a passage inside cabinet 110. Couplers 262, 272 include a water supply side coupler 262 connected to the second water supply part, and a water discharge side coupler 272 connected to the second water discharge part. Couplers 262, 272 are implemented as hoses formed of a flexible material, and are penetratingly-formed at a region next to the laundry introduction opening 111 of first tub 220. At least part of the couplers 262, 272 may be implemented as bellows-type pipes. By this construction of the couplers 262, 272, even if the door 120 is rotated, a connection part between the second water supply part and the second water discharge part does not interfere with the first door 120.

Referring to FIGS. 3 to 5, the second tub water supply passage 263 extends along inside of door frame 122, which extends from the water supply side connector 270*a* to the second tub injection nozzle 265. Second tub water supply passage 263 is connected to water supply connection pipe 261, by water supply side coupler 262. However, second tub water supply passage 263, and second tub injection nozzle 265 are not limited to such shapes, but may be modified in various manners.

Figure 7:
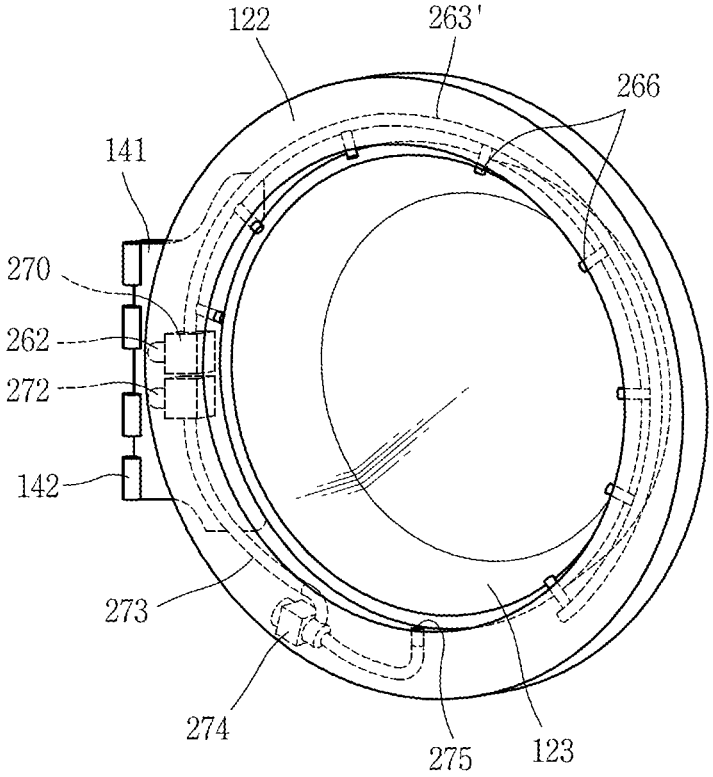
FIG. 7 is an enlarged perspective view of the first door, which illustrates another embodiment of the water supply passage of FIG. 5.

FIG. 7 illustrates a second tub water supply passage 263' according to another embodiment. Second tub water supply passage 263' according to another embodiment may extend along door frame 122, via an upper part of the second tub. Referring to FIG. 7, second tub water supply passage 263' extends by about 180° or more than, from door frame 122 where hinge supporting portion 141 is fixed, to door frame 122 on the opposite side. Referring to FIG. 7, a second tub injection nozzle 266 is installed on an inner circumferential surface of door frame 122. Second tub injection nozzle 266 has a plurality of outputs. In this case, the second tub injection nozzles 266 are radially arranged along door frame 122. The second tub injection nozzles 266 may communicate with the second tub water supply passage 263' respectively, thereby injecting washing water toward the second tub in a radial direction.

Since washing water is injected from an inner circumferential surface of the second tub in a radial direction, a washing process can be effectively performed due to an eddy current (vortex) formed at washing water accommodated in the second tub, even if rotation of laundry by an additional rotor such as the drum is not performed. Further, since washing water is injected to laundry from the second tub injection nozzles 266 arranged in a radial direction, a washing process can be effectively performed.

A shape or arrangement of the second tub water supply passage and the second tub injection nozzle, injection pressure of washing water injected to the second tub, etc. may be modified in various manners, according to an eddy current formed at washing water accommodated in the second tub, or according to a hit degree of laundry.

The second water discharge part is configured to discharge washing water from the second tub formed by bowl member 123. The second water discharge part is arranged in door frame 122, and extends to inside of cabinet 110 through hinge assembly 140.

The second water discharge part includes a second tub discharge hole 275 through which washing water accommodated in the second tub is discharged, a second tub water discharge passage 273 communicated with the second tub discharge hole 275 and extending up to hinge assembly 140 along door frame 122, a water discharge valve 274 installed at the second tub water discharge passage 273, and a water discharge connection pipe 271 connected to the second tub water discharge passage 273 at hinge assembly 140, and extending to water discharge pump 281. Water discharge connection pipe 271 is provided in cabinet 110.

Referring to FIGS. 5 and 6, the second tub water discharge passage 273 extends along the inside of door frame 122, which extends from water discharge side connector 270*b* to the second tub discharge hole 275. Further, second tub water discharge passage 273 is connected to water discharge connection pipe 271 by water discharge side coupler 272.

Second tub discharge hole 275 is installed at a lower central part of an inner circumferential surface of door frame 122, through which washing water inside the second tub is discharged. Water discharge valve 274 is installed at an intermediate part of the second tub water discharge passage 273 in door frame 122, and controls a discharge degree of washing water. When water discharge valve 274 is open, washing water is moved to pipe 283 along the second tub water discharge passage 273 by water discharge pump 281, to thus be discharged. However, is another embodiment, water discharge valve 274 may be provided at the water discharge connection pipe 271, not at second tub water discharge passage 273.

An electrical line (not shown) for controlling water discharge valve 274, etc. is installed in door frame 122, and is connected to the inside of cabinet 110 through hinge assembly 140. The electrical line may be electrically connected to a controller 180 installed at the cabinet 110.

Controller 180, a device for controlling components of the washing machine having a plurality of tubs, is configured to perform a corresponding control by being electrically connected to each of the components. Further, controller 180 may be electrically connected to control panel 116, thereby receiving a control command input through control panel 116.

Figure 8:
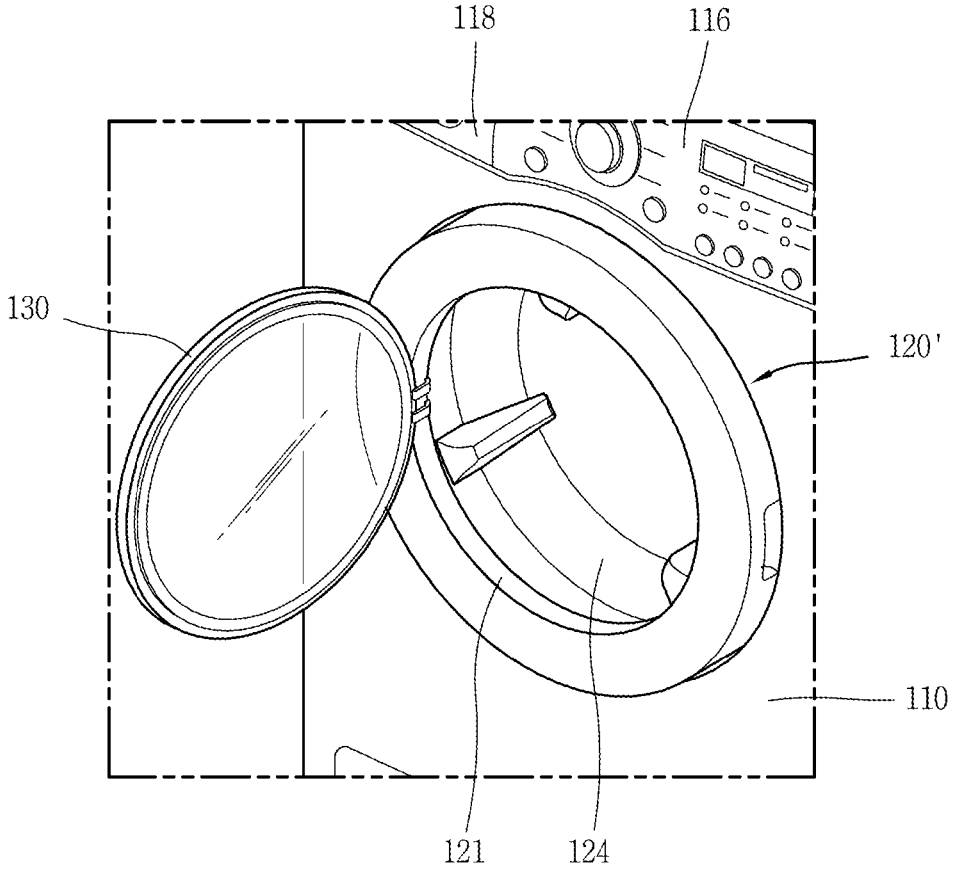
FIG. 8 is a perspective view of a washing machine having a plurality of tubs according to a second embodiment of the present invention, which illustrates that a second door is open and a first door is closed.
Figure 9:
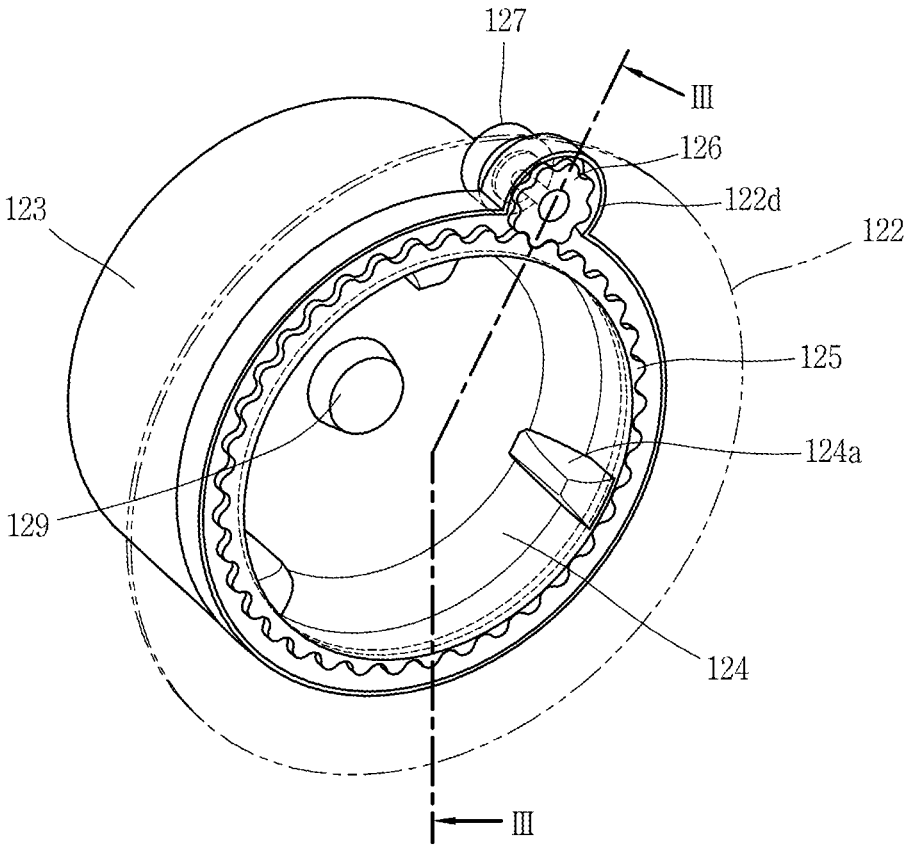
FIG. 9 is a perspective view of a second drum rotatably provided at the first door of FIG. 8, and a driving unit.
Figure 10:
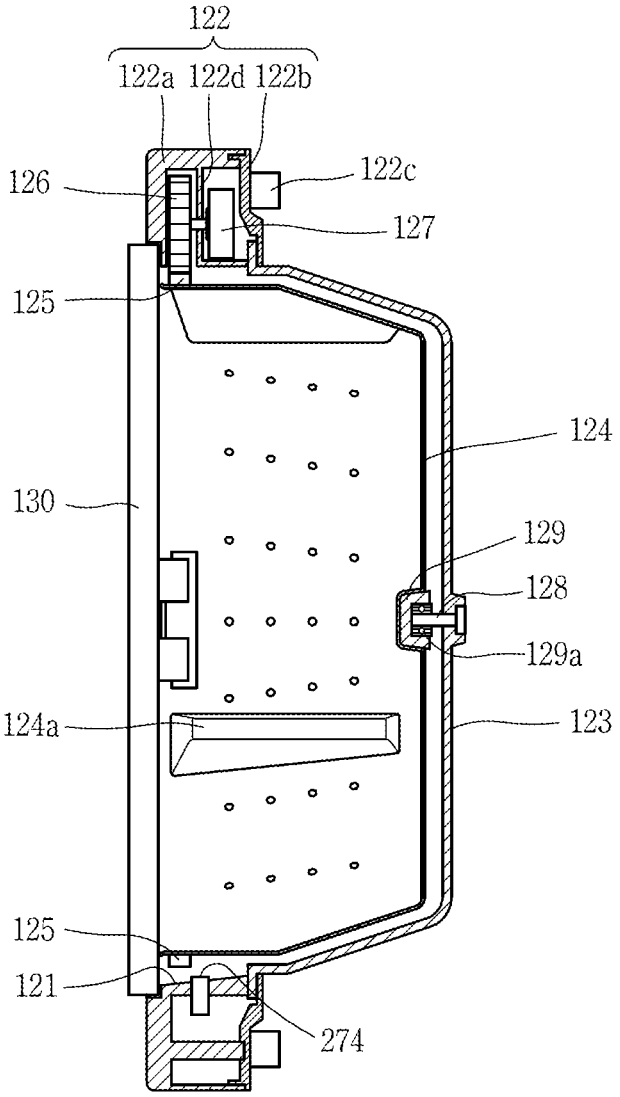
FIG. 10 is a sectional view taken along line 'III-III' in FIG. 9.

FIG. 8 is a front perspective view of a washing machine having a plurality of tubs according to a second embodiment of the present invention. FIG. 9 is a perspective view of a second drum and a driving unit according to a second embodiment of the present invention. FIG. 10 is a sectional view taken along line 'III-III' in FIG. 9. The second embodiment of the present invention is implemented as the first door of the first embodiment is modified, and thus the same configuration of the second embodiment as the first embodiment will not be explained.

Referring to FIG. 8, like in the first embodiment, a second door 130 is configured to open and close a laundry introduction opening 121 formed on a front surface of a first door 120'. Further, like in the first embodiment, the second door 130 is installed at door frame 122 so as to be hinge-rotated.

Referring to FIGS. 9 and 10, first door 120' may include a second tub for accommodating washing water, and a second drum 124 rotatably provided in the second tub. Second drum 124 is rotatably installed in a bowl member 123 which forms the second tub, for example by a bearing.

More specifically, second drum 124 is provided with a second drum bearing 129*a* and a second drum rotational shaft 128, at a space 129 protruding from a rear surface thereof. Second drum rotational shaft 128 is fixedly-connected to the inside of a rear surface of bowl member 123. And second drum bearing 129*a* is fixed to space 129 of the second drum 124, thereby rotatably supporting the second drum rotational shaft 128. Accordingly, second drum 124 can be rotated with respect to the second tub. Alternatively, the second drum rotational shaft 128 may be fixed to space 129 of second drum 124, and the second drum bearing 129*a* may be fixed to bowl member 123 to thus support second drum rotational shaft 128. A sealing member, configured to seal for prevention of leakage of washing water accommodated in the second drum 124 and the second tub to outside of the second tub, is further provided at the second drum bearing 129*a* and the second drum rotational shaft 128.

Second drum 124 is further provided with a plurality of lifts 124*a* on an inner surface thereof, and is provided with a plurality of through holes. Washing water to be supplied to the second tub may be introduced into the second drum 124 via the plurality of through holes.

A second drum driving unit is installed in door frame 122, and transmits a rotational force to second drum 124. A compartment 122*d*, configured to seal for prevention of leakage of washing water accommodated in the second tub to electronic components, is formed in door frame 122.

The second drum driving unit may include rack gears 125 formed on an outer circumferential surface of the second drum 124 with a wave shape or a saw-tooth shape, pinion gears 126 to engage with the rack gears 125, and a second drum driving motor 127 for rotating the pinion gears 126. Referring to FIG. 10, pinion gear 126 and second drum driving motor 127 are separated from each other by the compartment 122*d*, and a shaft for connecting pinion gear 126 and second drum driving motor 127 to each other is provided to pass through compartment 122*d*. In this case, the shaft is sealed. Thus, rack gears 125 and pinion gears 126 may be exposed to washing water, whereas the second drum driving motor 127 is not exposed to washing water.

Pinion gears 126 are installed on an outer circumferential surface of second drum 124 so as to be engaged with rack gears 125, and are rotated by second drum driving motor 127. As rack gears 125 are rotated by being engaged with pinion gears 126, second drum 124 is rotated. Second drum driving motor 127 is electrically connected to a controller 180 installed at cabinet 110, an external power source, and so on through hinge assembly 140.

In this configuration, since second drum 124 is further provided in the second tub, the same effect as provision of a plurality of drums can be obtained. Thus, a dehydration process as well as a washing process and a rinsing process can be performed in a plurality of spaces.

Further, under such a configuration, a small amount of laundry can be effectively washed and rinsed, through rotation of the second drum. That is, in case of washing a small amount of laundry, since the second tub and the second drum have a smaller size than the first tub and the first drum, the second tub and drum are used, and a washing effect can be obtained with a small amount of washing water. As a result, a consumption amount of washing water can be reduced, and costs (charges or bills) can be reduced. Further, since the second drum has a smaller size than the first drum, power required to rotate the second drum is relatively small. As a result, energy efficiency when washing a small amount of laundry can be enhanced.

A second water supply passage through which washing water is supplied to the second tub and the second drum, and a second water discharge passage through which the supplied washing water is discharged, have the same configuration as those of the first embodiment. Thus, detailed explanations of the second water supply passage and the second water discharge passage will be omitted. Further, since hinge assembly 140 has the same configuration as that of the first embodiment, detailed explanations thereof will be omitted.

Figure 11:
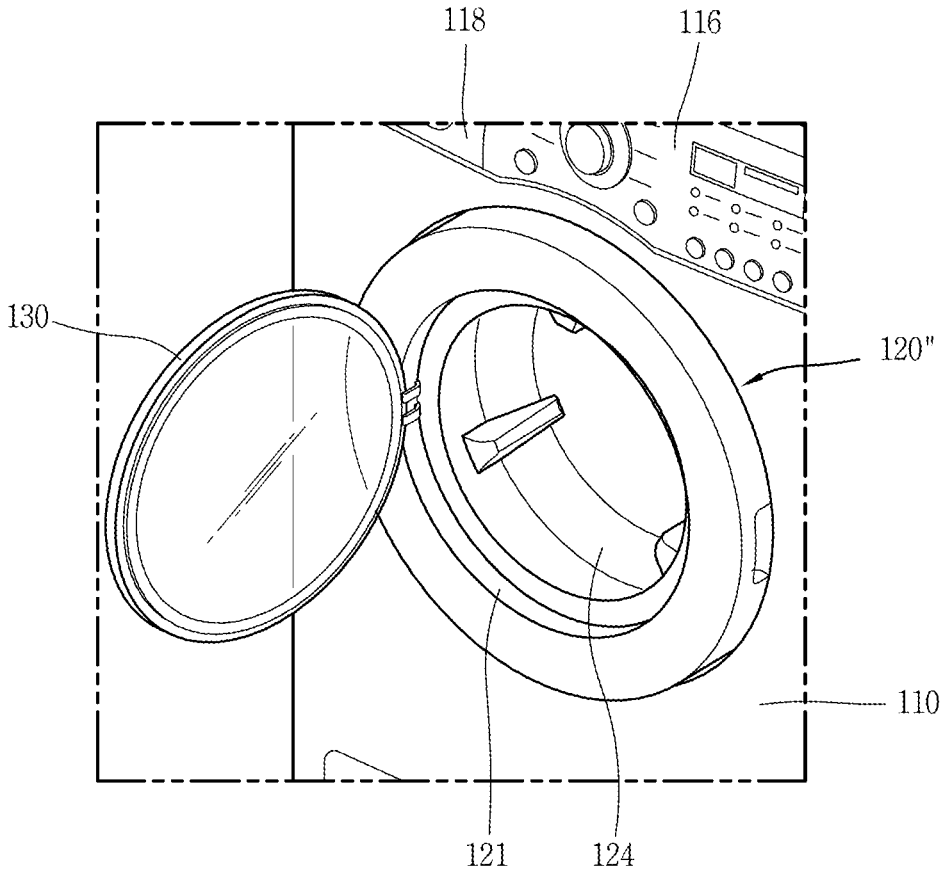
FIG. 11 is a perspective view of a washing machine having a plurality of tubs according to a third embodiment of the present invention, which illustrates that a second door is open and a first door is closed.
Figure 12:
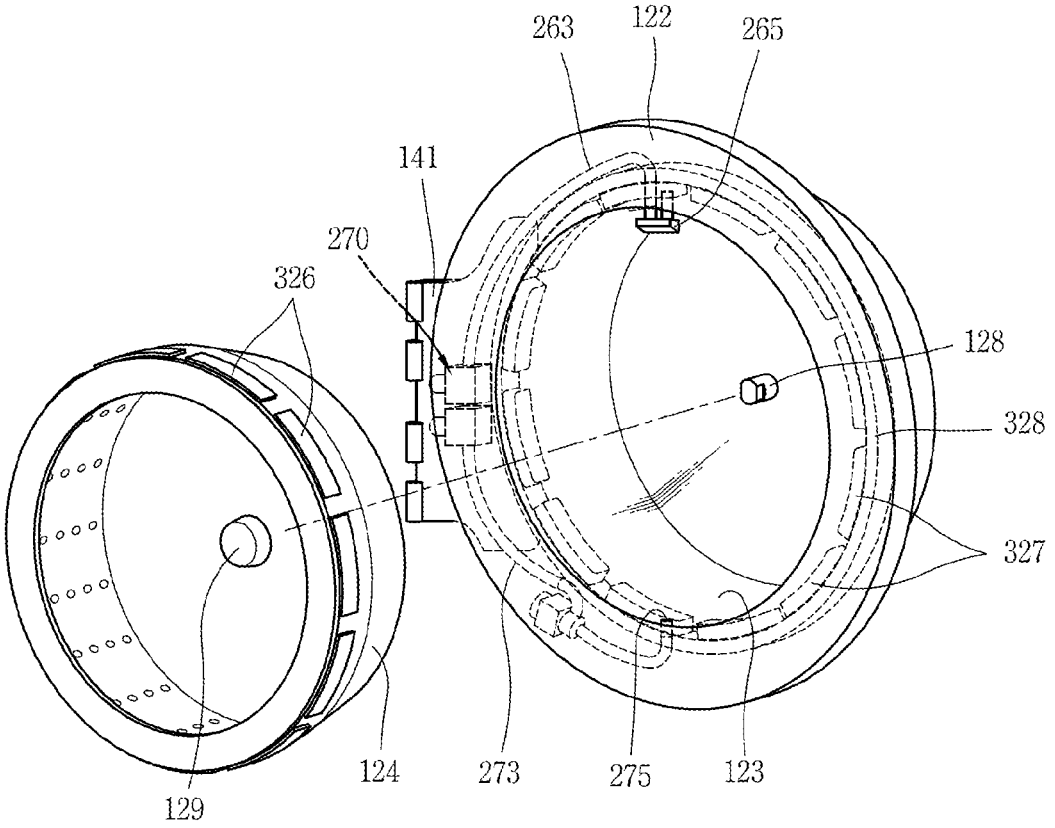
FIG. 12 is an exploded perspective view of the first door of FIG. 11.
Figure 13:
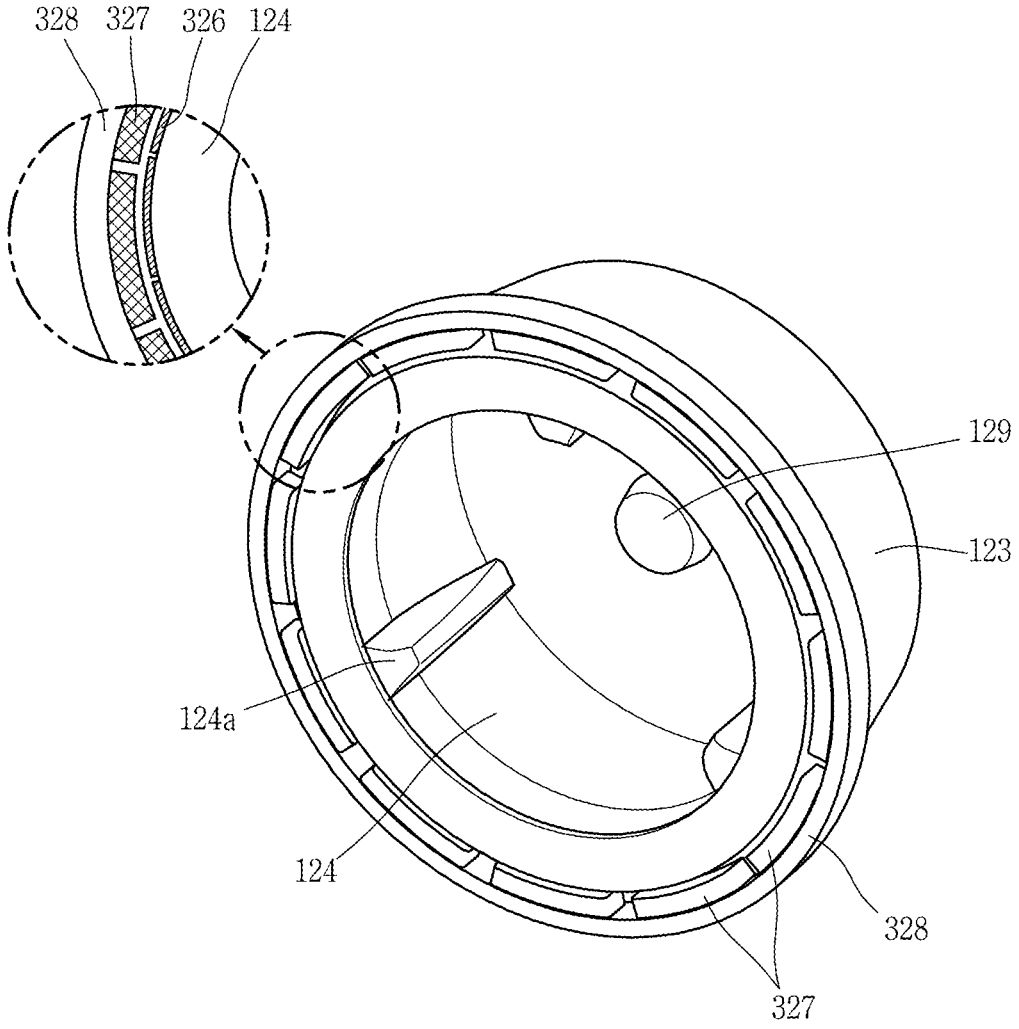
FIG. 13 is a perspective view illustrating a coupled state among a second drum, a second tub and a driving unit of FIG. 11.

FIG. 11 is a perspective view of a washing machine having a plurality of tubs according to a third embodiment of the present invention. FIG. 12 is a perspective view illustrating that a second drum is separated from a first door according to a third embodiment of the present invention. FIG. 13 is a perspective view of a second tub and a second drum according to a third embodiment of the present invention. The third embodiment according to the present invention is implemented as the first door of the first embodiment is modified, and thus the same configuration as the first embodiment will not be explained.

Referring to FIG. 11, like in the first embodiment, a second door 130 is configured to open and close a laundry introduction opening 121 formed on a front surface of a first door 120". Further, like in the first embodiment, second door 130 is installed at door frame 122 so as to be hinge-rotated.

Referring to FIGS. 12 and 13, first door 120" may include a second tub for accommodating therein washing water, and a second drum rotatably provided in the second tub. Like in the second embodiment, second drum 124 is rotatably installed in a bowl member 123. That is, second drum 124 is provided with a second drum bearing and a second drum rotational shaft 128, at a space 129 protruding from a rear surface thereof. Detailed explanations of the configuration will be omitted, since the configuration is the same as that of the second embodiment.

Second drum 124 is further provided with a plurality of lifts 124*a* on an inner surface thereof. Further, second drum 124 is provided with a plurality of through holes, such that washing water to be supplied to the second tub is introduced into second drum 124 via the through holes.

A second drum driving unit includes a plurality of magnets 326 installed at second drum 124, and a stator core 328 and coils 327 provided at door frame 122 so as to face the plurality of magnets 326. Stator core 328 is formed to have a ring shape, and is disposed outside an outer circumferential surface of second drum 124 in a spaced manner from the outer circumferential surface of second drum 124. The plurality of magnets 326 are radially attached to the outer circumferential surface of second drum 124. Between the magnets 326 and stator core 328, coils 327 are radially arranged. Once current is applied to coils 327, second drum 124 is rotated with respect to the second tub. Stator core 328 and coils 327 are installed outside the second tub, so as not to be exposed to washing water.

As aforementioned, current applied to coils 327 is supplied through an electrical wire connected from cabinet 110 to door frame 122 through hinge assembly 140. Alternatively, as aforementioned, the current may be controlled by being electrically connected to the controller.

The second drum serves as a rotor as the magnets are installed on the outer circumferential surface of the second drum, and the door frame serves as a stator as the stator core and the coils are installed at the door frame. Thus, an additional stator and rotor for rotating the second drum are not required, and the entire configuration is simplified.

A second water supply passage through which washing water is supplied to the second tub and the second drum, and a second water discharge passage through which the supplied washing water is discharged, have the same configuration as those of the first embodiment. Thus, detailed explanations of the second water supply passage and the second water discharge passage will be omitted. Further, since hinge assembly 140 has the same configuration as that of the first embodiment, detailed explanations thereof will be omitted.

Figure 14:
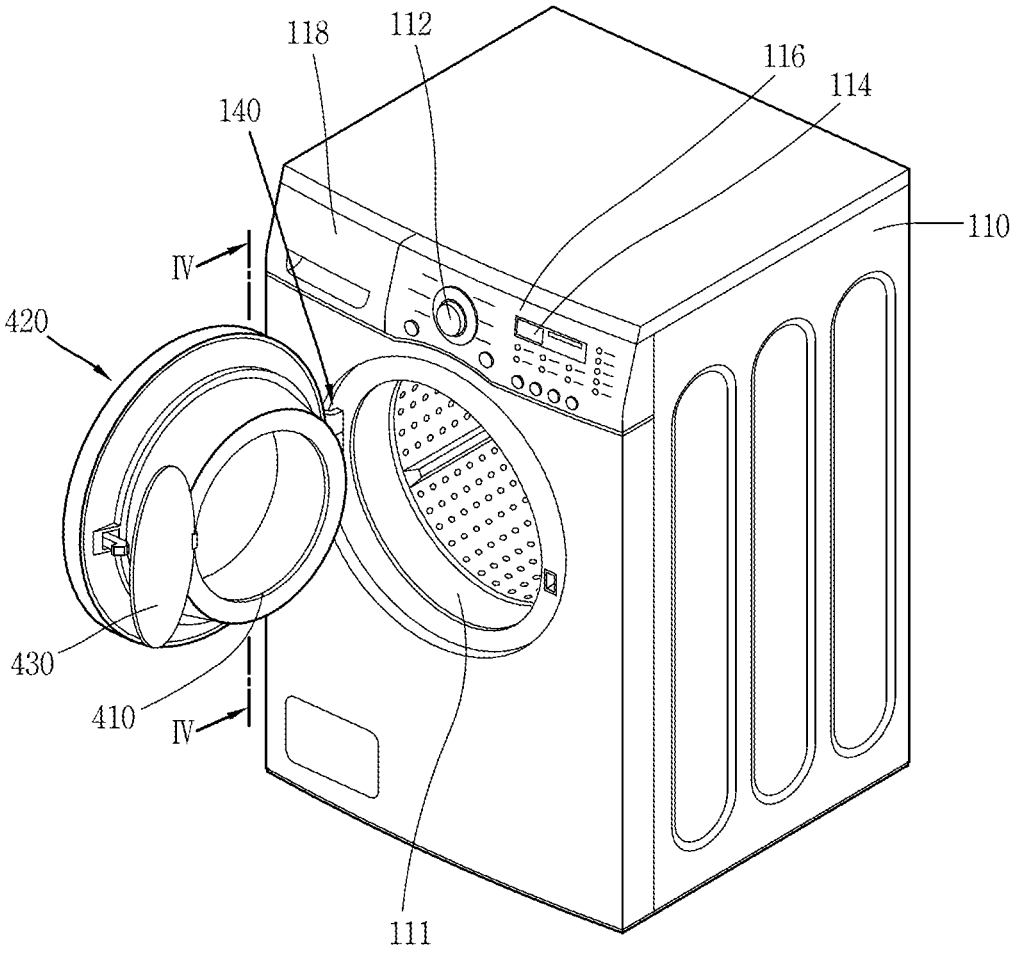
FIG. 14 is a perspective view of a washing machine having a plurality of tubs according to a fourth embodiment of the present invention, which illustrates that both a first door and a second door are open.
Figure 15:
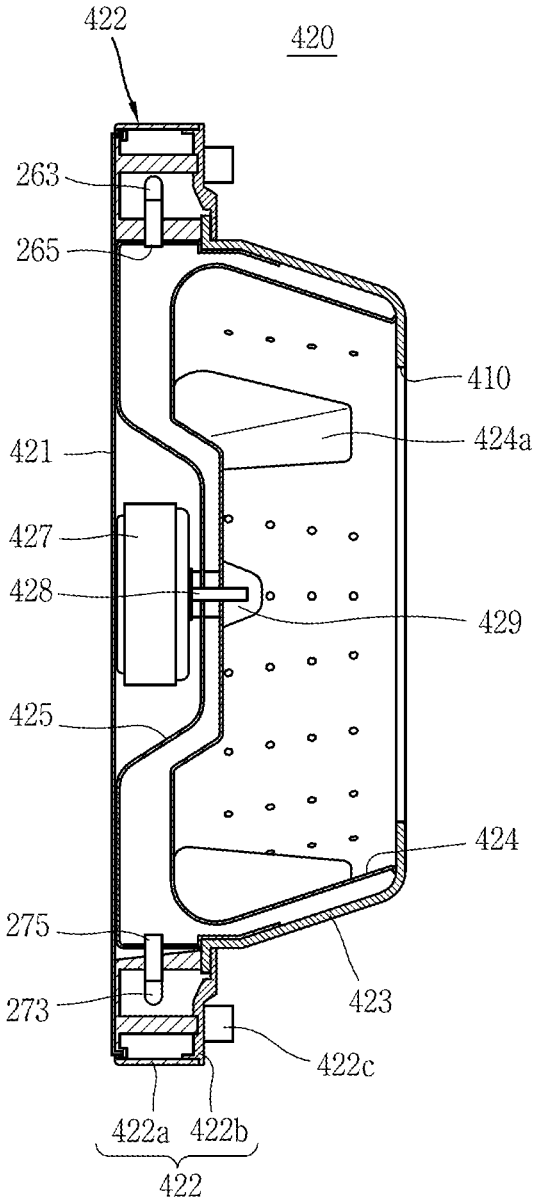
FIG. 15 is a sectional view taken along line 'IV-IV' in FIG. 14.

FIG. 14 is a perspective view of a washing machine having a plurality of tubs according to a fourth embodiment of the present invention. FIG. 15 is a sectional view taken along line 'IV-IV' in FIG. 14. Unlike in the first to third embodiments, in the fourth embodiment, laundry can be introduced into a laundry introduction opening 410 of a second tub, only in an open state of a first door 420. That is, first door 420 according to the fourth embodiment is formed as laundry introduction opening 410 of the second tub is open toward a rear side of cabinet 110, and a front surface of first door 420 is closed. Laundry introduction opening 410 of the second tub is opened and closed by a second door 430.

Referring to FIGS. 14 and 15, first door 420 includes door frames 421, 422 configured to open and close a laundry introduction opening 111 of a first tub, a second tub forming member for forming the second tub, and a hinge assembly 140 configured to mount door frames 421, 422 so as to be rotatable with respect to the cabinet. Hinge assembly 140 has the same configuration as that of the first embodiment, and thus its detailed explanations will be omitted. The fourth embodiment is the same as the first to third embodiments except for a configuration of the first door, and an installation position of the second door, and thus the same configuration will not be explained.

The door frames include an edge frame 422, and a front cover 421 coupled to the edge frame 422 and configured to block a front surface of the first door. Edge frame 422 forms an edge of the first door, and includes therein a second water supply passage and a second water discharge passage. Edge frame 422 has the same configuration as door frame 122 of the first embodiment. That is, edge frame 422 is a ring-shaped frame which forms an outer circumference of the first door, and a central part thereof is open as a circular shape.

The edge frame includes an outer frame 422*a* which forms a front surface, and an inner frame 422*b* which forms a rear surface. Front cover 421 is coupled to outer frame 422*a*, thereby blocking an opening formed at a central part of edge frame 422. A ring-shaped sealing member 422*c* having an elastic force is further provided at the inner frame 422*b*, thereby sealing a space between the first door and the cabinet.

The second tub forming member includes a second tub space forming member 423 which includes a space portion by being extended from an opening of the outer frame 422*a* toward a rear side of the cabinet, and which forms laundry introduction opening 410 of the second tub. Laundry introduction opening 410 is formed on the rear surface of the second tub space forming member 423. An edge of the second tub space forming member 423 is fittedly-coupled between outer frame 422*a* and inner frame 422*b*. Referring to FIG. 15, the second tub space forming member 423 is fittedly-coupled to edge frame 422 as a flange is formed on an outer circumferential surface thereof. Further, the second tub space forming member 423 includes a circular shape of the laundry introduction opening 410 of the second tub formed at a rear surface thereof toward a rear side of the cabinet.

The second tub forming member further includes a second tub surface forming member 425 which forms a space for accommodating a second drum driving motor 427 between the second tub space forming member 423 and the front cover 421. Second tub surface forming member 425 is configured to seal a space between the second tub space forming member 423 and the door frame. The second tub surface forming member 425 forms a space for accommodating the second drum driving motor 427, as a central part thereof protrudes toward a rear side of cabinet 110. That is, the second tub surface forming member 425 radially extends from the central part toward front cover 421 in an inclined manner, and then extends up to an inner circumferential surface of the edge frame 422 along front cover 421.

The second tub surface forming member 425 is bent from the inner circumferential surface of edge frame 422, thereby extending toward a rear side of the cabinet along an inner circumferential surface of edge frame 422. Then, the second tub surface forming member 425 further extends along an inner side surface of the second tub space forming member 423. The second tub surface forming member 425 extends along a connection part between the second tub space forming member 423 and edge frame 422, thereby preventing leakage of water to the connection part. Further, a second tub injection nozzle 265 and a water discharge hole 275 are penetratingly-installed at part of the second tub surface forming member 425, the part facing an inner circumferential surface of edge frame 422. Through the second tub injection nozzle 265 and the water discharge hole 275, washing water is supplied to and discharged from the second tub.

First door 420 may further include a second drum rotatably installed at a second tub formed by the second tub forming member, such that a washing process, a rinsing process, and a dehydration process are performed. A protrusion 429, formed at a central part of second drum 424, is coupled to a second drum rotational shaft 428. Second drum rotational shaft 428 is rotatably supported by a bearing, and is connected to the second drum driving motor 427 by passing through the second tub surface forming member 425 to thus receive a rotational force. The second drum rotational shaft 428 and the bearing are sealed, for prevention of leakage of washing water accommodated in the second tub.

Second drum 424 is further provided with a plurality of lifts 424*a* on an inner surface thereof, and is provided with a plurality of through holes. Washing water to be supplied to the second tub may be introduced into the second drum 424 via the plurality of through holes.

As the second drum driving motor 427, any driving motor capable of transmitting a rotational force to the second drum rotational shaft 428, may be used. Second drum driving motor 427 is fixed between the second tub forming member and front cover 421.

Under such a configuration, a generic motor may be used as the second drum driving motor. Further, since the laundry introduction opening 111 of the first tub is formed to face the laundry introduction opening 410 of the second tub, mixed laundry required to be washed separately may be directly input to the first tub and the second tub, in a separated manner. This can enhance a user's convenience.

A second water supply passage through which washing water is supplied to the second tub and the second drum, and a second water discharge passage through which the supplied washing water is discharged, have the same configuration as those of the first embodiment. Thus, detailed explanations of the second water supply passage and the second water discharge passage will be omitted. As aforementioned, the second water supply passage and the second water discharge passage are provided at door frame 122 in the first embodiment, whereas they are provided at the edge frame 422 in the fourth embodiment. As aforementioned, edge frame 422 is formed in the same manner as door frame 122.

Figure 16:
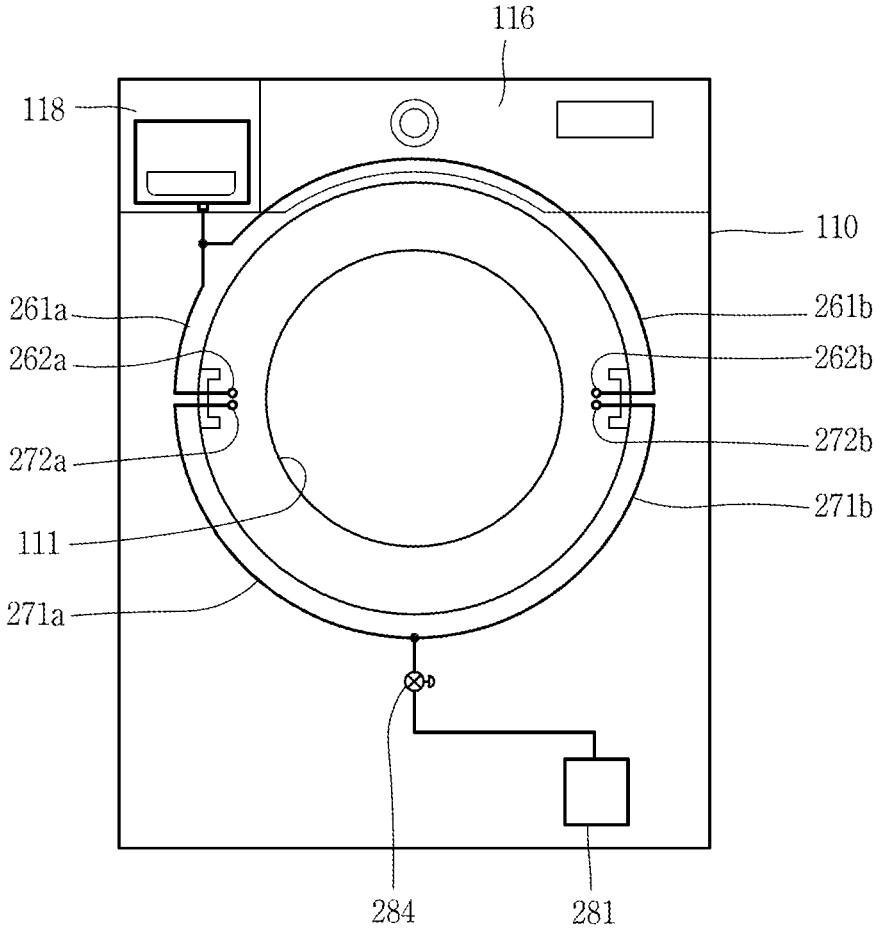
FIG. 16 is a frontal view of a washing machine having a plurality of tubs according to a fifth embodiment of the present invention, which illustrates a state prior to installation of a first door.
Figure 17:
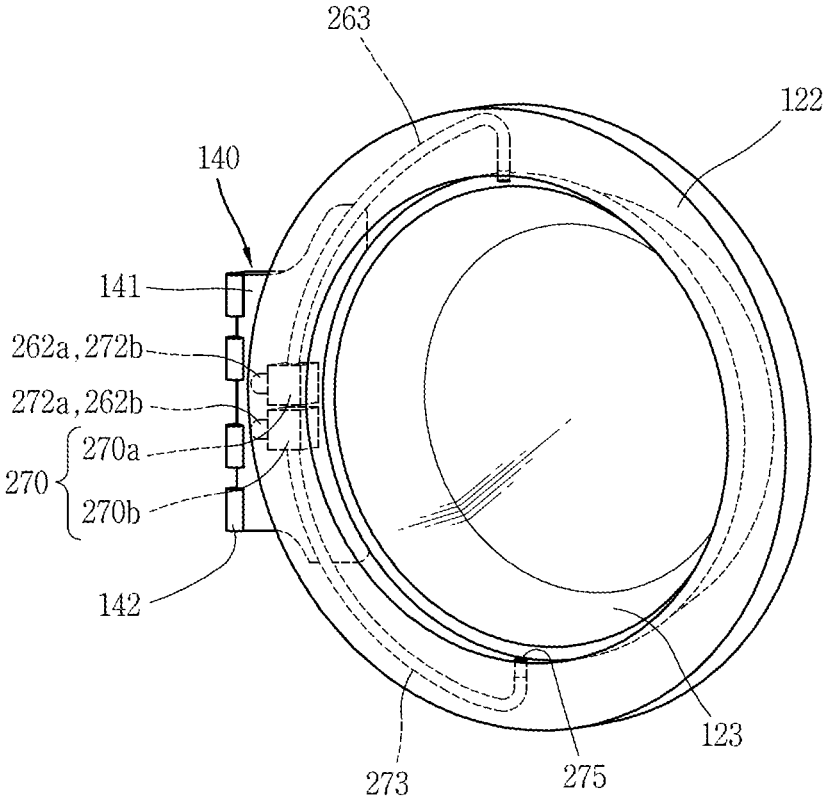
FIG. 17 is a perspective view of a first door of FIG. 16.

FIGS. 16 and 17 illustrates a washing machine having a plurality of tubs according to a fifth embodiment of the present invention. According to a modified embodiment of FIGS. 16 and 17, an installation position of a hinge shaft of the first door may be changed to the right side from the left side, or may be changed to the left side from the right side. That is, the fifth embodiment of the present invention is implemented so that the hinge assembly can be installed on the left side or on the right side of the laundry introduction opening 111, with consideration of an installation place of the washing machine or a user.

Referring to FIG. 16, couplers are installed on the left side and on the right side of laundry introduction opening 111. First couplers 262*a*, 272*a* on the left side of laundry introduction opening 111 include a water supply side coupler 262*a*, and a water discharge side coupler 272*a*. Second couplers 262*b*, 272*b* on the right side of laundry introduction opening 111 include a water supply side coupler 262*b*, and a water discharge side coupler 272*b*.

The water supply side coupler 262*a* (the first coupler) is connected to a first is water supply connection pipe 261*a* diverged from the aforementioned water supply connection pipe 261, and the water discharge side coupler 272*a* (the first coupler) is connected to a first water discharge connection pipe 271*a* diverged from the aforementioned water discharge connection pipe 271.

The water supply side coupler 262*b* (the second coupler) is connected to a second water supply connection pipe 261*b* diverged from the aforementioned water supply connection pipe 261, and the water discharge side coupler 272*b* (the second coupler) is connected to a second water discharge connection pipe 271*b* diverged from the aforementioned water discharge connection pipe 271.

Referring to FIG. 17, in order to selectively mount a first door to the left side and the right side according to a modified embodiment, the second tub water supply passage and the second tub water discharge passage of the first door 120 according to the first embodiment are symmetrical to each other. Referring to FIG. 17, unlike the aforementioned configuration, end portions of the second tub water supply passage 263 connected to the second tub are not provided with injection nozzles, but are provided with only injection holes. A water discharge valve 284 is not mounted to the second tub water discharge passage 273. The water discharge valve 284 is provided at the water discharge connection pipe inside the cabinet.

When the hinge assembly is installed on the left side of laundry introduction opening 111, the first door is installed as shown in FIG. 17. On the contrary, when the hinge assembly is installed on the right side of laundry introduction opening 111, the first door shown in FIG. 17 is rotated by 180° so that the position of the hinge assembly can be changed in a simple manner.

In the case where the hinge assembly is installed on the right side of laundry introduction opening 111, the second tub water supply passage 263 of FIG. 17 serves as a water discharge passage, and the second tub water discharge passage 273 serves as a water supply passage.

The first door according to the fifth embodiment may be applicable to the first to fourth embodiments. In this case, the second tub water discharge valve according to the first to fourth embodiments is formed in the cabinet. For instance, the second tub water discharge valve may be provided at the water discharge connection pipe 271.

The same reference numerals as those of the aforementioned embodiments will not be explained.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A washing machine, comprising:

a cabinet having a first tub disposed therein;

a first drum rotatably disposed in the first tub;

a first door, having a second tub disposed therein, to open and close a laundry introduction opening formed at the cabinet;

a hinge assembly to rotatably mount the first door to the cabinet;

a second drum rotatably disposed in the second tub, the second drum configured to rotate apart from the first drum;

a driving unit to rotate the second drum within the second tub;

a second door to open and close a laundry introduction opening of the second tub;

a first water supply part and a second water supply part to supply washing water to the first tub and the second tub, respectively; and a first water discharge part and a second water discharge part to discharge washing water from the first tub and the second tub, respectively.

2. The washing machine of claim 1, wherein the first door includes:

a bowl member forming the second tub; and a door frame to support an outer circumferential surface of the bowl member.

3. The washing machine of claim 2, wherein the driving unit includes pinion gears mounted inside the door frame, and a driving motor to rotate the pinion gears, and wherein the pinion gears are arranged to be engaged with rack gears formed on an outer circumferential surface of the second drum.

4. The washing machine of claim 3, wherein the driving motor and the pinion gears are arranged at an upper part of the door frame.

5. The washing machine of claim 2, wherein the driving unit includes:

a plurality of magnets radially arranged on an outer circumferential surface of the second drum; and a stator core and coils disposed at the bowl member and facing the magnets.

6. The washing machine of claim 2, wherein a rotational shaft for supporting a rear surface of the second drum is provided at the second tub.

7. The washing machine of claim 2, wherein the second water supply part and the second water discharge part include a water supply passage and a water discharge passage disposed on an outer circumferential surface of the door frame, respectively.

8. The washing machine of claim 7, wherein the water supply passage includes one or more injection nozzles to inject washing water into the second tub.

9. The washing machine of claim 1, wherein the second door is positioned on a front surface of the cabinet.

10. The washing machine of claim 1, wherein the first door includes:

a door frame to open and close the laundry introduction opening; and a second tub forming member protruding from the door frame toward a rear side of the cabinet to form a space between itself and the door frame, and including a laundry introduction opening to be opened toward a rear side of the cabinet.

11. The washing machine of claim 10, wherein the driving unit includes:

a rotational shaft connected to the second drum by passing through the second tub forming member; and a driving motor disposed at the space between the second tub forming member and the door frame, and configured to rotate the rotational shaft.

12. The washing machine of claim 10, wherein the second water supply part and the second water discharge part include a water supply passage and a water discharge passage disposed on an outer circumferential surface of the door frame, respectively.

13. The washing machine of claim 1, wherein the second water supply part and the second water discharge part extend from the first door, through the hinge assembly, to inside of the cabinet.

* * * * *